US005308066A

United States Patent [19]

Pataki et al.

[11] Patent Number: 5,308,066

[45] Date of Patent: May 3, 1994

[54] SPHERICAL PUZZLE TOY

[76] Inventors: Zoltan Pataki, Zalaegerszeg, Hegyalja U. 20., Hungary; Geza Csomos, Heimhuder Str. 46, D-2000, Hamburg 13, Fed. Rep. of Germany; Pal Boda, H-8171 Balatonvilagos, Csok Istvan Setany, Hungary

[21] Appl. No.: 835,477

[22] PCT Filed: Jul. 30, 1990

[86] PCT No.: PCT/HU90/00056

§ 371 Date: Apr. 8, 1992

§ 102(e) Date: Apr. 8, 1992

[87] PCT Pub. No.: WO91/03293

PCT Pub. Date: Mar. 21, 1991

[30] Foreign Application Priority Data

Sep. 6, 1989 [HU] Hungary ..... 4652
Mar. 30, 1990 [HU] Hungary ..... 4652

[51] Int. Cl.[5] ..... A63F 9/08
[52] U.S. Cl. ..... 273/153 S
[58] Field of Search ..... 273/153 S, 155, 152 R

[56] References Cited

U.S. PATENT DOCUMENTS 4,405,131 9/1983 Horvath ..... 273/153 S
4,856,786 8/1989 Gyovai ..... 273/153 S
4,865,323 9/1989 Heusinkveld ..... 273/153 S

FOREIGN PATENT DOCUMENTS 3104023 5/1981 Fed. Rep. of Germany ... 273/153 S
3127757 2/1983 Fed. Rep. of Germany ... 273/153 S
0228174 10/1985 German Democratic Rep. ..... 273/153 S

*Primary Examiner*—V. Millin
*Assistant Examiner*—Steven B. Wong
*Attorney, Agent, or Firm*—Ladas & Parry

[57] ABSTRACT

A spherical puzzle toy has a central member with four radial shanks defining respective axes intersecting at a common point representing a center of a spherical surface of the puzzle toy. Mounted on the central member are first and second groups of shaped bodies which collectively form the outer spherical surface of the toy. The first group of bodies is comprised of four identical bodies each having an inner portion respectively secured on the shanks of the central member in radial extension thereof and an outer portion forming a first part of the spherical surface of the puzzle toy. The inner portion has a tapered form with radial surfaces, while the outer portion has a spherical triangular shape. The second group of bodies are slidably supported by the first group of bodies and include inner portions of tapered form with radial surfaces which are slidable on one another and on the radial surfaces of the first group of bodies. The second group of bodies is of two types; one including outer portions of spherical triangular shape, while the other includes outer portions of spherical square shape. The outer portions undergo a relative change of position on the spherical surface when the bodies of the second group are slidably moved relative to the bodies of the first group. Various surface ornamentations can be provided on the spherical surface requiring skill and dexterity for realizing a determined configuration.

20 Claims, 15 Drawing Sheets

SPHERICAL PUZZLE TOY

TECHNICAL FIELD

The present invention relates to a solid puzzle toy of spherical shape having a central member and bodies or figures that can be divided into three different groups which can be rotated about axes which intersect in a center of the spherical shape of the toy.

BACKGROUND ART

Many solid toy puzzle devices are known whose purpose is the rearrangement by turning the elements composing the toy, around given co-ordinate axes. The best known among these toys is the solution described in HU-PS 170.062. In this toy or puzzle device, inside a main cube there is a small cube which has a flexible pin in the direction of each axis passing through the cube. The main cube is composed of 27 spatial bodies or figures of cube shape which correspond with the form of the main cube. The rearrangement of the small cubes can be performed by rotating them about axes which are orthogonally related.

Another solid logical toy is described in HU-PS 180.385. The solid logical toy described in this patent specification comprises a main body which has the form of an octahedron and of elements which can be divided into three different groups which are substantially of octahedron form. The rearrangement of the elements is effected by rotating the elements about four co-ordinate axes. The disadvantage of this well-known toy is that the regular main body—in the present case the octahedron—is surrounded by planes and the rearrangement of surface features is effected by the relative position of the planes.

SUMMARY OF THE INVENTION

It is a principal object of the present invention to provide a new solid logical puzzle toy which on the one hand widens the scope of the already existing solid logical toys of similar kind and on the other hand, in which the joining and moving of the figures forming the main body can be solved more simply and better, compared to the solutions known so far. In a preferred embodiment of the invention, it is possible that besides the rearrangement of the figures forming the main body, rearrangement of indicia also can be effected on the surface of the body.

The invention provides a spherical puzzle toy comprising:

- a central member, including four radial shanks defining respective axes intersecting at a common point representing a center of a spherical surface of the puzzle toy;
- a first group of four identical bodies respectively secured on said shanks in radial extension thereof, each of said four bodies including an inner portion secured on its respective shank and an outer portion forming a first part of the spherical surface of said puzzle toy, said inner portion having a tapered form with radial surfaces, said outer portion having a spherical, triangular shape;
- a second group of bodies slidably supported by said first group of bodies and including inner portions of tapered form with radial surfaces which are slidable on one another and on the radial surfaces of said first group of bodies, said second group of bodies being of two types, one including outer portions of spherical, triangular shape, the other outer portions of spherical square shape, the outer portions of said first and second groups collectively forming said spherical surface of the puzzle toy, said outer portions undergoing relative change of positions on said spherical surface when bodies of said second group are slidably moved relative to the bodies of said first group.

In an advantageous form of the solid puzzle device according to the present invention, the central member is formed of two congruent elements, the shanks of which form with each other an angle of about 109.5 degrees.

In a preferred embodiment, the outside surface of the bodies forming the outer surface of the toy puzzle is provided with distinguishing indicia, such as colors and/or numbers and/or letters and/or pictures and/or other surface features.

BRIEF DESCRIPTION OF THE DRAWINGS

The invention is described in detail in the following, with reference to the accompanying drawings showing some preferable embodiments of the solid puzzle device, where.

BEST MODE OF CARRYING OUT THE INVENTION

Figure 1:
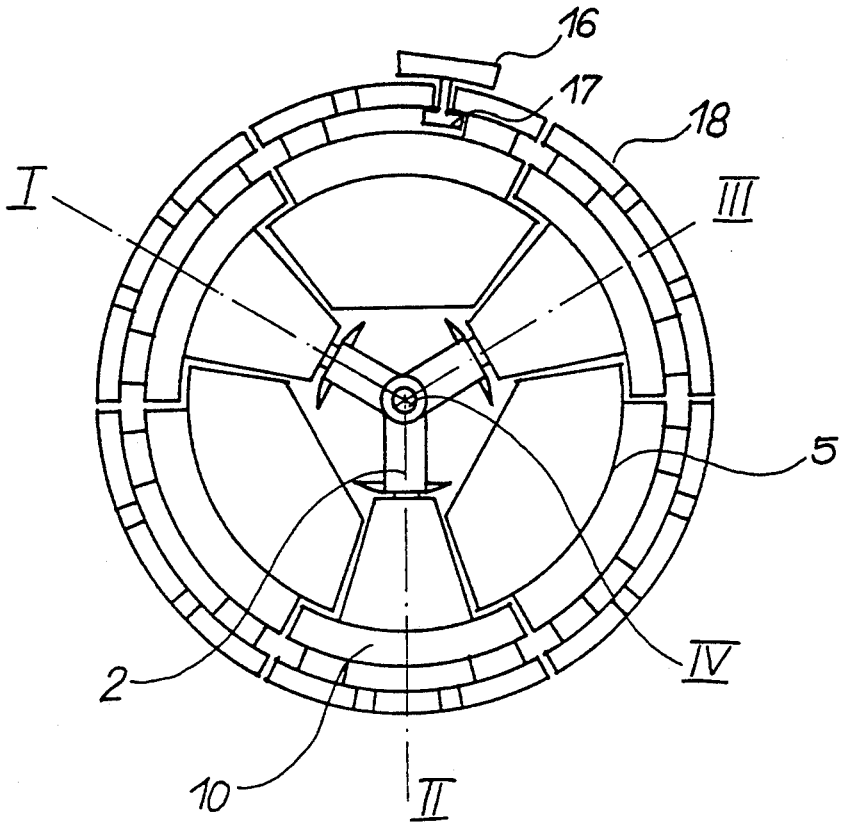
FIG. 1 is a sectional view taken along the plane including the equatorial circle of the solid puzzle device.

FIG. 1 illustrates a sectional view taken along a plane including the equatorial circle of a main stage in spherical body 1 of the solid puzzle device according to the present invention. FIG. 1 shows a central member 2 defining co-ordinate axes intersecting the geometrical center of the main body 1, determining at the same time main directions of adjustable means of the main body 1, the adjustable means including bodies of figures 10 fixed to the central member 2; movable bodies or figures 5 supported by figures 10, the relation and the connection of the movable figures 5 as well as the surface of the fixed figures 10 and that of the movable figures 5 and thus the surface of the main body 1 as well as the surface 18 surrounding the main body 1 being controlled by rotation provided by said axes.

Figure 8:
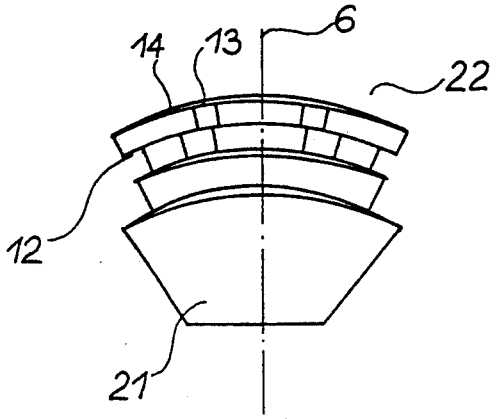
FIG. 8 is a front view of the movable body of FIG. 7.
Figure 10:
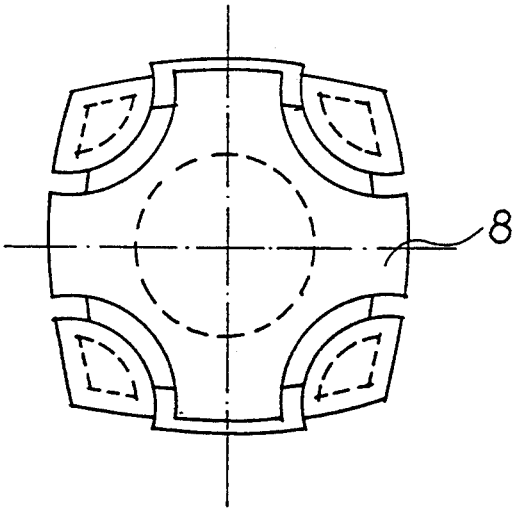
FIG. 10 is a top view of another movable body of the device of FIG. 1.

It should be noted, that movable figures 8 forming the main body 1, arranged among the fixed figures 10 cannot be seen in FIG. 1. In the shell-surface 18 can be found pathways assuring the movement of indicia elements 16. The indicia elements 16 are of disk-form and at their lower surface they are provided with extensions of T-shape 17, which are placed in slots formed in the fixed figures 10 and in the shaped-figures 5 as well as in the shaped-figures 8, the slots serving for promoting the guiding of the indicia elements 16.

Figure 2:
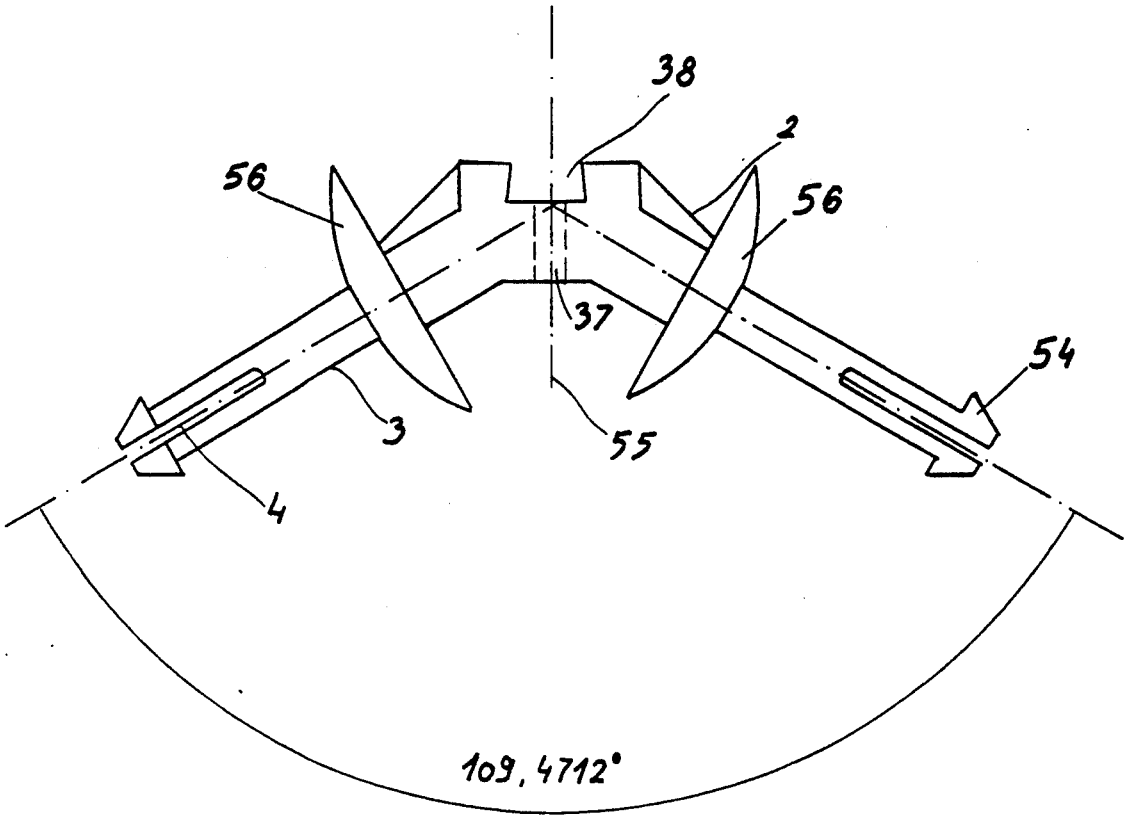
FIG. 2 is a side view of a half of the central member of the device of FIG. 1.

In FIG. 2 there is illustrated a side view of half of the central member 2 of the solid puzzle device shown in FIG. 1. The central member 2 arranged in the inside of the main body 1, having shanks 3 lying in the direction appropriate with the main directions of rotation is comprised of two congruent element-halves. The two element-halves are connected at a groove 38 formed along the axis 55 crossing the intersection point of the axes of the shanks 3; the two congruent element-halves of the same shape are fixed to each other by a pin placed in a bore 37 having a common axis with the axis 55 and the other element-half. The shanks 3 of the central member 2 form with other an angle of approximately 109.5 degrees.

The shanks 3 of the central member 2 end in a head-piece 54 of a cone-frustum shape and are provided with axial slots 4 starting from the head-piece. This construction of the shanks 3 of the central member 2 assures the fixation of the shaped-figures attached to the central member 2, i.e. the shanks 3 of the central member 2 can be simply snapped into the shaped-figures 10.

Figure 5:
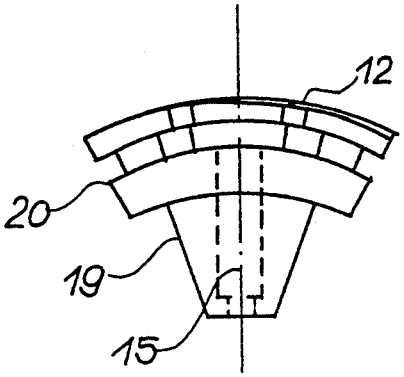
FIG. 5 is a front view of the fixed body of FIG. 4.

The connecting figures 5, 8 abut against the shoulder 56 formed on the shank 3 of the central member 2.

Figure 3:
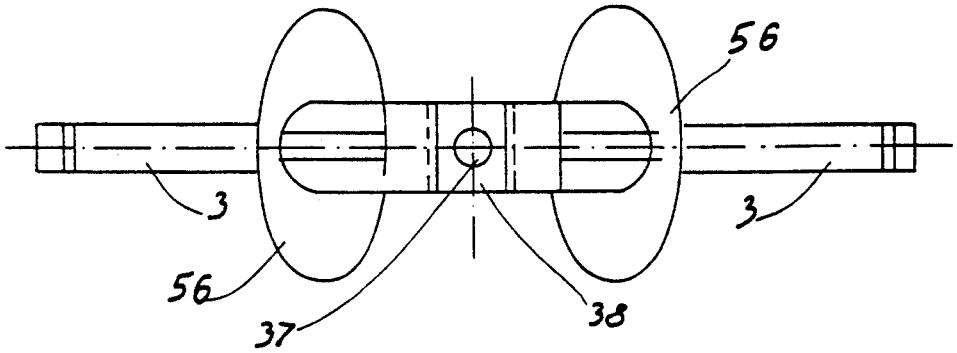
FIG. 3 is a top view of a half of the central member of the device of FIG. 1.

FIG. 3 illustrates a top view of the central member 2 of FIG. 2, showing the arrangement of the groove 38 receiving the connecting figure-half as well as the bore 37 receiving the pin, fixing the element-halves.

Figure 4:
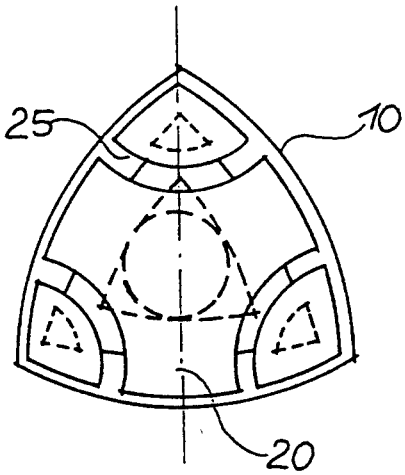
FIG. 4 is a top view of the fixed body of the device of FIG. 1.

FIG. 4 illustrates a top view of the shaped-figure 10 of the main body 1 of the solid puzzle device according to the present invention as well as a part of the surface of the shell 18 surrounding the main body 1 fixed to the central member 2. The surface of the fixed figure 10, which is at the same time the main body 1 as well as a part surface of the shell 18 surrounding the main body 1, has the form of an arched-triangle i.e. a spherical triangle, and is provided with slots 12 guiding the indicia elements 16.

Figure 6:
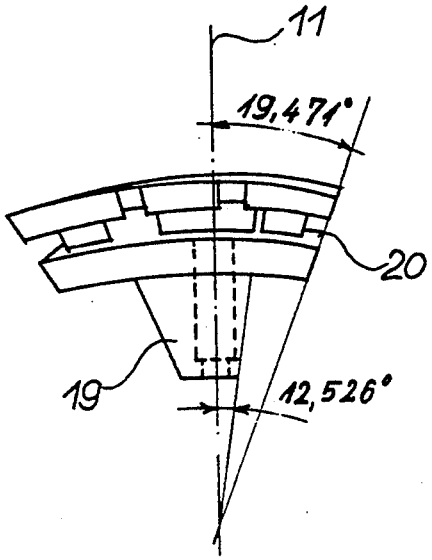
FIG. 6 is a side view of the fixed body of FIG. 4.

FIG. 5 illustrates a front view of the fixed figure 10. As already mentioned, the fixed figure 10 is connected to the central member 2, thus its footing 19 of cone-frustum type with a curved radial, face is provided with a hole 16 receiving the shank 2 of the central member 2. The collared head-piece 20 assuring the movement of the indicia element 16, including a section of the pathways 25 is connected to the footing 19 and they form together a common unit. The fixed figure 10 has an asymmetric formation. It is well shown in FIG. 6 as one side of the footing 19 forms an angle of 12.526 degrees, while the same side of the head-piece 20 forms an angle of 19.471 degrees with the axis 11 of the hole 15.

Figure 7:
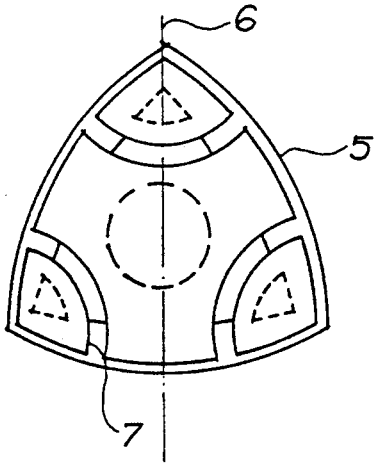
FIG 7 is a top view of a movable body of the device of FIG. 1.

FIG. 7 illustrates a top view of the movable shaped-figure 5 arranged between the fixed figures 10 and slidable relative to the fixed figures 10. The surface of the movable shaped-figure 5, as well as a part of the surface of the shell 18 surrounding the main body 1, which is at the same time the main body 1, has the form of an arched-triangle i.e. a spherical triangle and includes a part of the path 7 serving for the movement of the indicia elements.

FIG. 8 illustrates a front view of the movable shaped-figure 5 in FIG. 7. The movable shaped-figure 5 is formed fundamentally of a footing 21 of cone-frustum type, with a curved radial face, and of a head-piece 22 provided with slots 12 guiding the elements 16, connected to the footing 21, forming together with it a whole unit.

Figure 9:
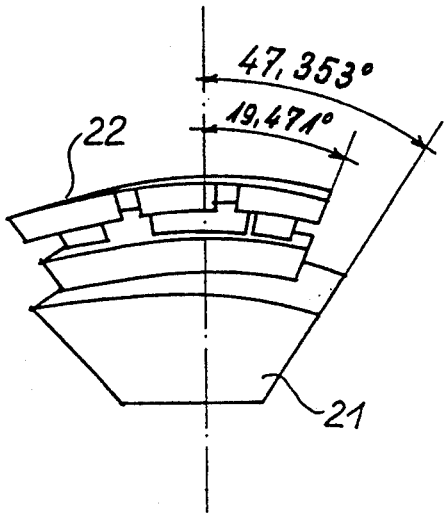
FIG. 9 is a side view of the movable body of FIG. 7.

The movable shaped figure 5 is also asymmetrical which is well shown in a side-view (see FIG. 9) as on the one side the symmetry axis forms with the footing 21 an angle of 47.353 degrees, while it forms with the head-piece 22 an angle of 19.471 degrees.

FIG. 10 illustrates a top view of the figure 10 fixed to the central member 2 and the movable shaped-figure 8 arranged among the movable shaped-figures 5. The movable shaped-figure 8 surrounding the main body 1 and its surface forming part of the surface of the shell 18 are of arched-square type i.e. a spherical square and this surface of the movable shaped-figure 8 includes also a part of the pathways serving for the movement of the elements 16.

Figure 11:
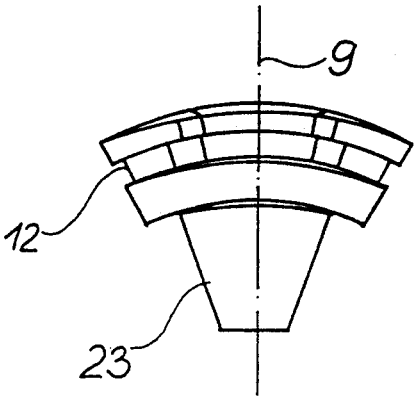
FIG. 11 is a top view of the movable body of FIG. 10.

FIG. 11 illustrates a front view of the movable shaped-figure 8 in FIG. 10. The movable shaped-figure 8 is formed of a footing 23 of cone-frustum type with a curved radial face and of a collared head-piece 24 provided with slots 12, guiding the elements 16, this headpiece is connected with the footing 23, forming together therewith a common unit.

Figure 12:
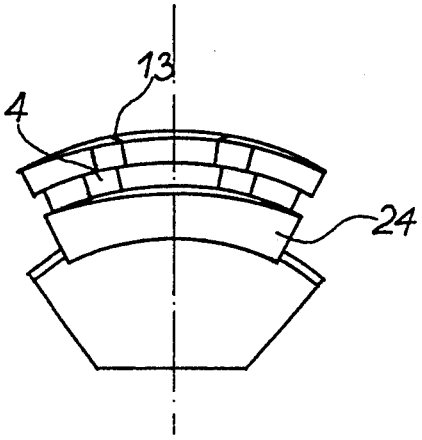
FIG. 12 is a side view of the movable body of FIG. 10.

The side view of the movable shaped-figure 8 is illustrated in FIG. 12.

Figure 13:
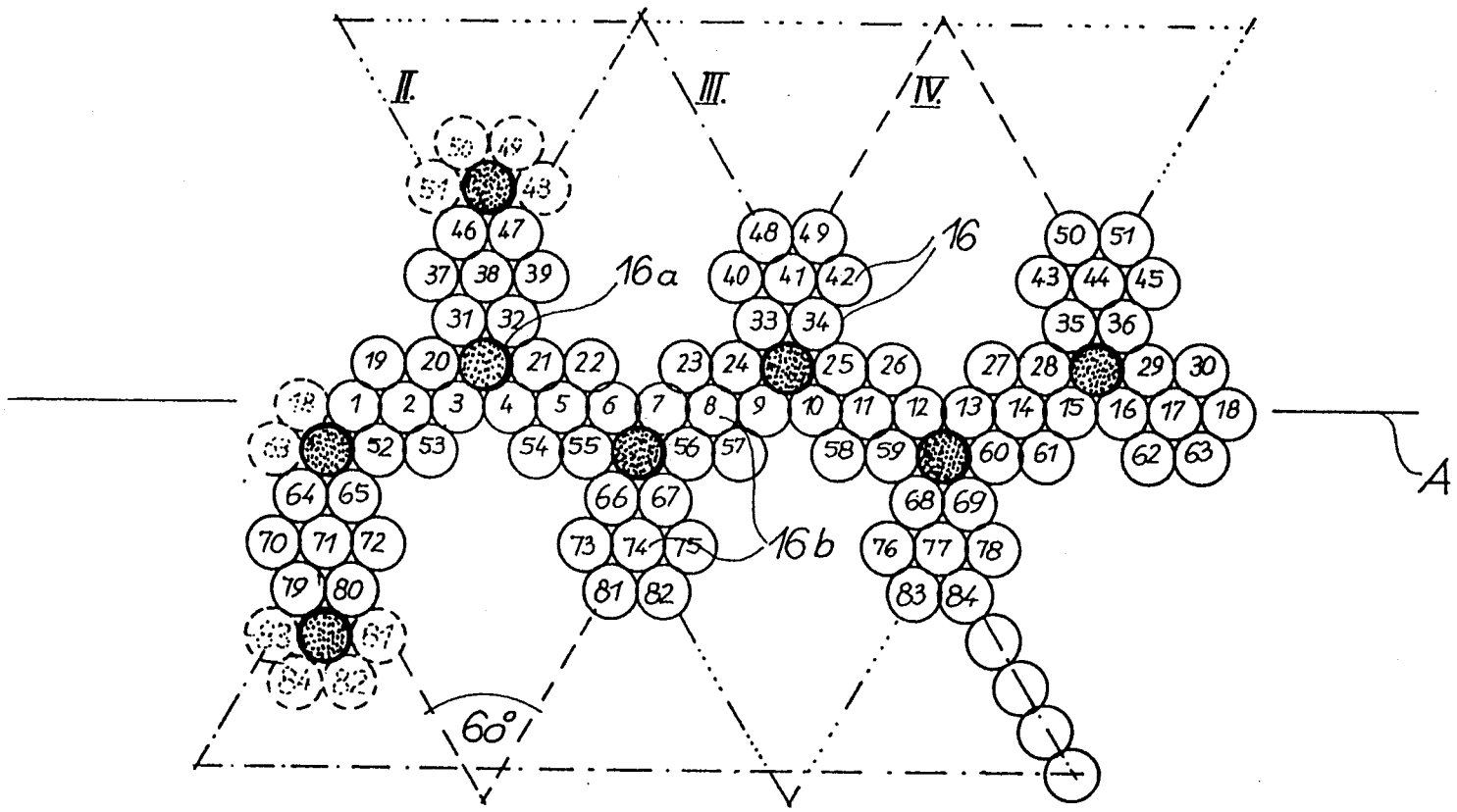
FIG. 13 is a developed view in a plane showing the rearrangement of the solid puzzle device according to the present invention provided with indicia arranged like petals.

In case of a solid puzzle device built up from the elements mentioned above, when developed in a plane, the center lines of the pathways formed on the surface of the shell 18 form with each other an angle of 60 degrees (see FIG. 13) and both the surface of the main body 1 and that of the shell 18 are provided with twelve connection or intersection points. The relation of these points of connection is as follows: there are six points of intersection in alternating direction respectively above and below equatorial circles of the main body 1. There are four equatorial circles along which rotation of the bodies can take place and these are determined by the direction of the shanks 3 and are designated I, II, III and IV. Above each of the equational circles there are six further points of intersection also in alternating direction. At the points of intersection a fixed indicia element 16*a* is arranged and the further indicia elements 16 can be moved along the slots in the figures 5, 8, 10.

The movable and fixed elements 16, 16*a* are of disk-form and on their lower surface they are provided with extensions of T-shape 17 inserted into the slots 12 on the head-piece situated on the shaped-figures forming the surface of the shell 18 surrounding the main body 1. The surfaces of the elements 16, 16*a* are provided with distinguishing surface features such as colors and/or numbers and/or letters and/or other indicia.

In a preferred embodiment of the present invention, the elements 16 are arranged in the pathways on the surface of the shell surrounding the main body 1 like petals, in a way that on the great circle of the main body 1, oriented, for example, in the main direction of rotation I, there are eighteen elements 16 with the same diameter, and in the elements 16 every third element 16*b* forms the central element of a petal. These elements 16*b* are surrounded by six further elements 16 all of which and also the central element have the same diameter and the latter six elements are in contact with the central element 16*b*. The elements 16 and 16*b* situated along the main directions of rotation I, II, III, IV can be freely moved, while the elements 16*a* situated on circles parallel to the main directions of rotation I, II, III, IV forming the central element of a petal are arranged in the eighteen points of intersection formed on the surface of the shell 18 and these elements 16*a* remain in place during rearrangement (see FIG. 13). The distinguishing characteristic or feature e.g. color of the elements 16*a* is in each case identical with the color of the shell 18.

The aim of the toy according to the invention is that in the case of elements 16, 16*a* and 16*b* provided e.g. with colors, petals of the same color should be created. This is effected in the following manner: the elements 16 should be moved along the main directions of rotation I, II, III and IV and should be rotated about the fixed elements 16*a* arranged at the intersection points. This operation should be continued as long as the desired purpose has been achieved e.g. until all the petals are of the same color.

This embodiment of the invention ensures the possibility of a number of rearrangement methods. For example, in the case where elements 16 are provided with letters, the toy can be practically considered as a spatial cross-word puzzle and the aim of the toy may be to form words, sentences along the main directions of rotation I, II, III and IV and that the petals should also include words with meaning.

It is to be noted that in the case of an embodiment without a shell-surface, the rearrangement is effected by rotating the shaped-figures 5, 8, 10, 26, 27, 33, 39, 44 and 49 forming the main body 1 in the main directions of rotation I, II, III and IV.

Figure 14:
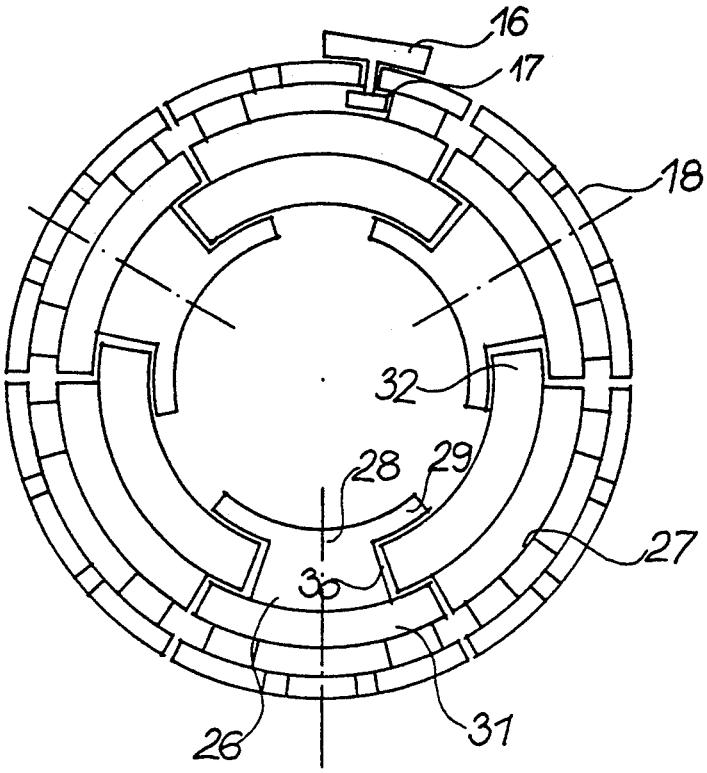
FIG. 14 is a sectional view taken along the plane including the equatorial circle of another preferred embodiment of the solid puzzle device according to the present invention.
Figure 26:
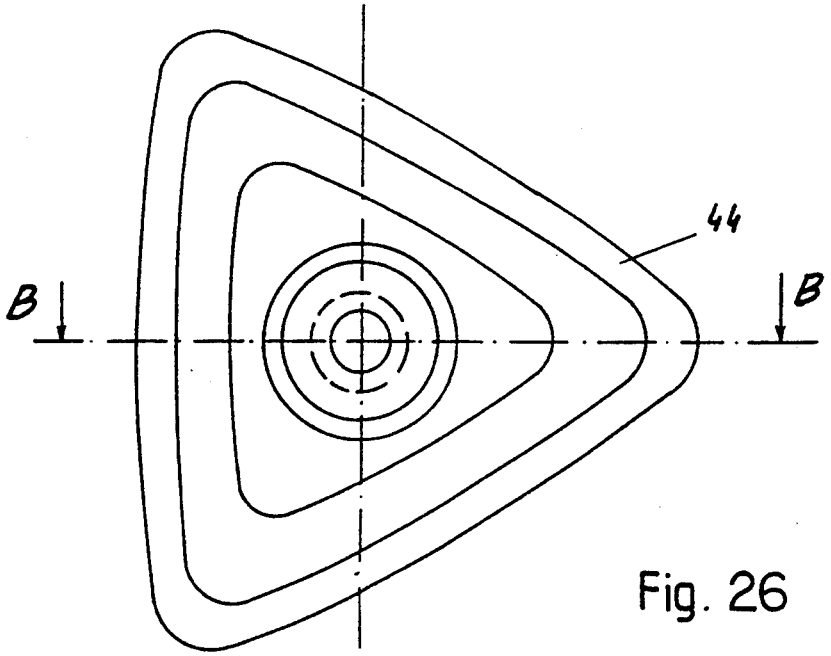
FIG. 26 is a top view of an inside element-part of one of the movable figures of the main body, attached to the body of FIG. 24.

FIG. 14 illustrates a sectional view taken along a plane including the equatorial circle of the main body 1 of another possible embodiment of the solid puzzle device according to the present invention. In this embodiment, the toy does not have any central member; thus compared with the embodiment in FIG. 1, it cannot be disassembled. The logical toy in FIG. 14 is also built up from shaped-figures, the characteristic of the shaping of these figures is that the elements cannot move in radial direction and at the same time they are self-closing. FIG. 14 shows the connection of shaped-figures 26 and 27 to each other. In this embodiment, the function of shaped-figure 26 is practically the same as the function of the shaped-figure 10 of the embodiment illustrated in FIG. 1, but compared with the shaped-figure 10, the shaped-figure 26 is not fixed. The symmetry axis of the shaped-figure 26 is coincidental with the main rotation axes. On the footing 28 of the shaped-figure 26 there is a guiding extension 29 and between the footing 28 and the head-piece 31—which consist practically of one piece— there is a groove 30. The extension 32 of the connecting figure 27 extends into this groove 30, in self-closing manner. The shell 18 appropriate for the moving of the elements 16 explained in detail above and the pathways formed in the shell 18 on the head-piece of the respective shaped figures can be found in this embodiment as well.

It should be noted, however, that the toy even without this shell-part 18 assures an enjoyable leisure time. In this case the outside surface of the shaped-figures forming the main body serves as a supporting surface and in provided with distinguishing marking or indicia. The points of intersection—altogether twelve, referred to above, are also present here and the rearrangement of the indicia elements is effected along these points of intersection.

The embodiment of the toy in FIG. 14 is different from the embodiment illustrated in FIG. 1 and thus the form of the shaped-figures constituting the main body of the toy is also different from several points of view. The form of these shaped-figures can be seen in FIGS. 15 to 23.

Figure 15:
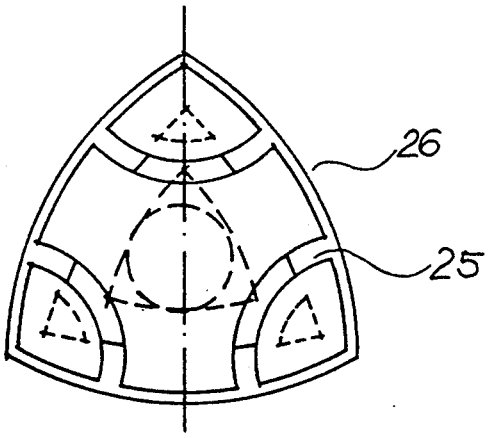
FIG. 15 is a top view of a body belonging to the first group of the device of FIG. 14.

FIG. 15 illustrates a top view of the shaped-figure 26 together with the pathways 25 arranged on the shell 18 surrounding the main body 1.

Figure 16:
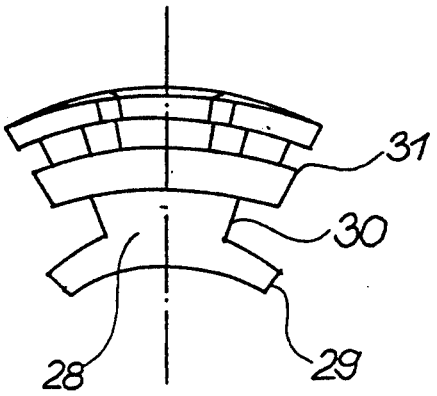
FIG. 16 is a front view of the body of FIG. 15.

FIG. 16 illustrates a front view of the shaped-figure 26. Also the shaped-figure 26 consists of a footing 28 and of a head-piece 31, forming together with the footing 28 is a common unit.

The footing 28 is provided with a guiding extension 29 while between the footing 28 and the headpiece 31 there is a groove 30 receiving the extension of the connecting shaped-figure.

Figure 17:
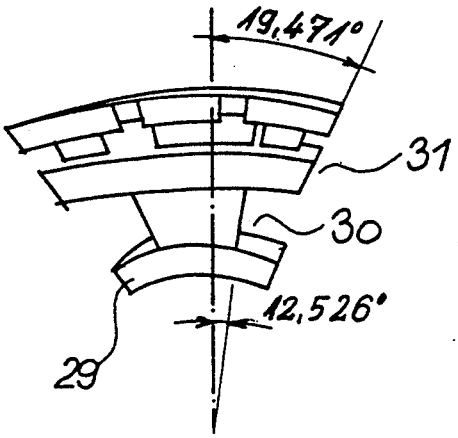
FIG. 17 is a side view of the body of FIG. 15.

FIG. 17 illustrates a side view of the shaped-figure 26, showing the asymmetrical form of the shaped-figure 26. The asymmetry is the same as that of the figure illustrated in FIG. 6.

Figure 18:
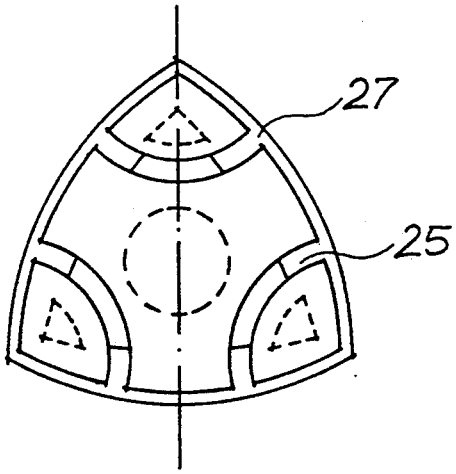
FIG. 18 is a top view of a body from the second group of the device of FIG. 14.
Figure 27:
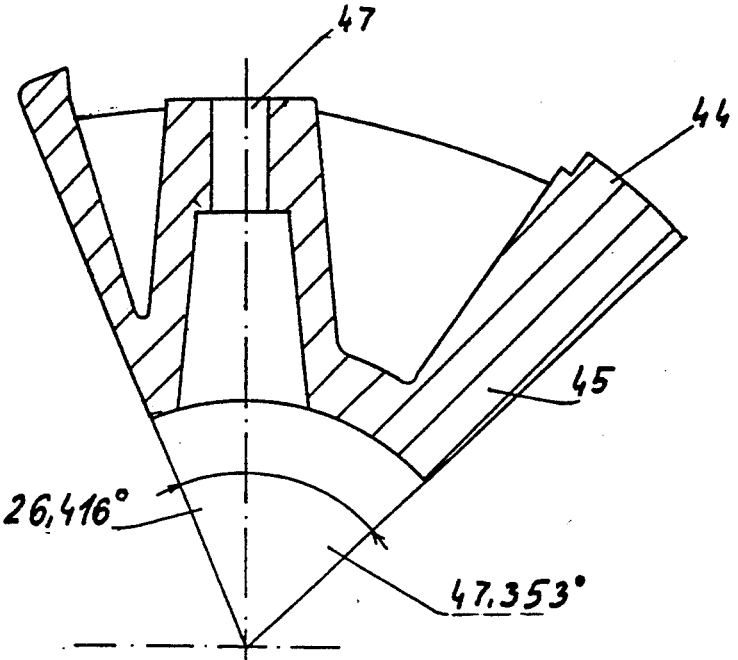
FIG. 27 is a sectional view taken along line B—B in FIG. 26.

FIG. 18 illustrates a top view of the shaped-figure 27, showing the form of the pathway 25 of the path arranged on the shell 18.

Figure 19:
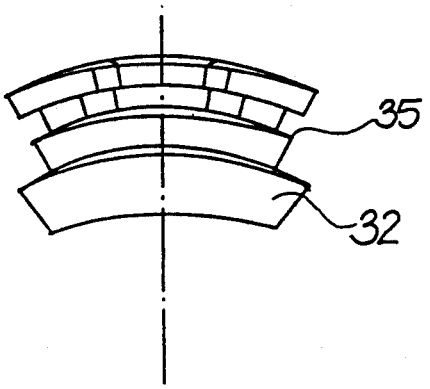
FIG. 19 is a front view of the body of FIG. 18.

FIG. 19 illustrates the shaped-figure in FIG. 18 together with the extension 32 protruding into the groove 30 of the shaped-figure 26 as well as the form of the head-piece 35 of the shaped-figure 27.

Figure 20:
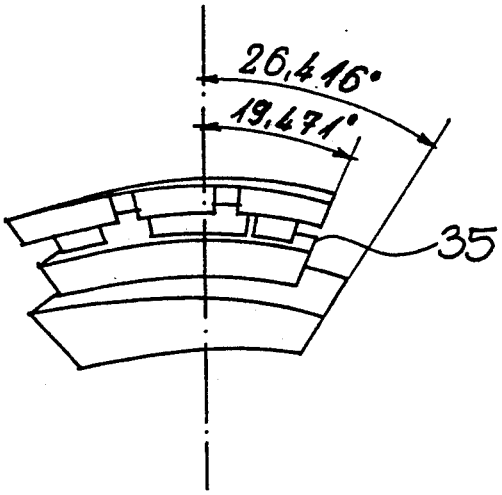
FIG. 20 is a side view of the body of FIG. 18.

FIG. 20 illustrates a side view of the shaped-figure 27 in FIG. 18, the shaped-figure 27 also having an asymmetrical form.

Figure 22:
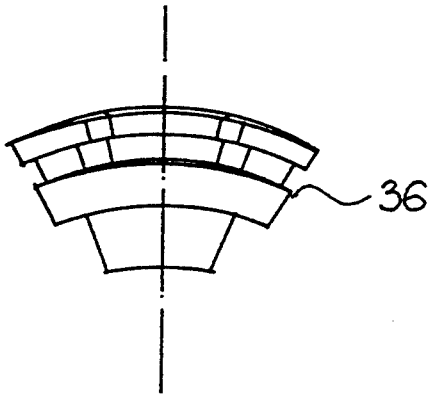
FIG. 22 is a front view of the body of FIG. 21.
Figure 23:
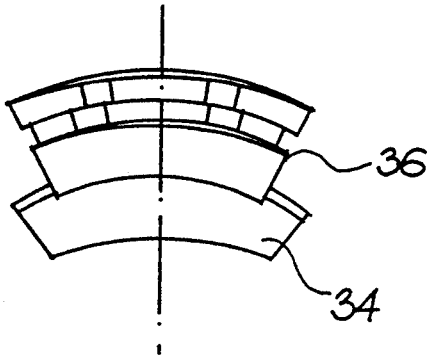
FIG. 23 is a side view of the body of FIG. 21.
Figure 21:
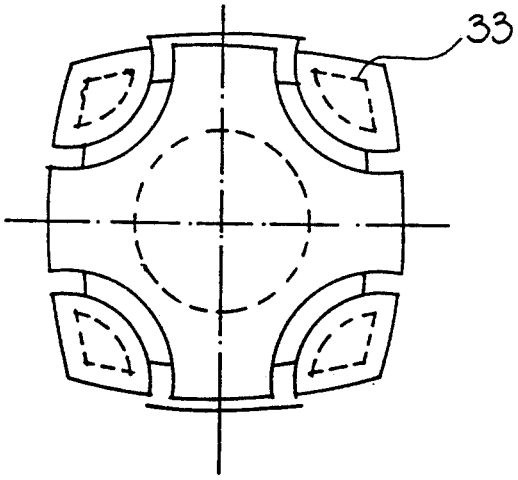
FIG. 21 is a top view of a body belonging to the third group of the device of FIG. 14.
Figure 33:
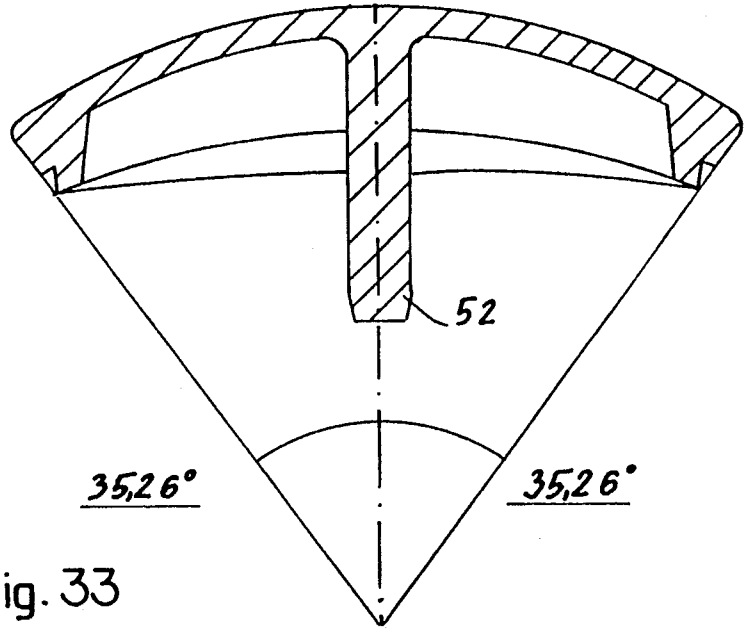
FIG. 33 is a sectional view taken along line E—E in FIG. 32.

Finally, FIGS. 21 to 23 illustrate the form of the shaped-figure 33 forming the third group. FIG. 21 is a top-view of the shaped-figure 33, FIG. 22 is a front-view of the same, while FIG. 23 is a side-view of the shaped-figure 33 with the form of the head-piece 35 as well as that of the extension 34 connected to the other shaped-figure.

The operation of the toy illustrated in FIG. 14 is identical with that of the toy shown in FIG. 1 and described in detail, thus its description is not necessary.

Figure 24:
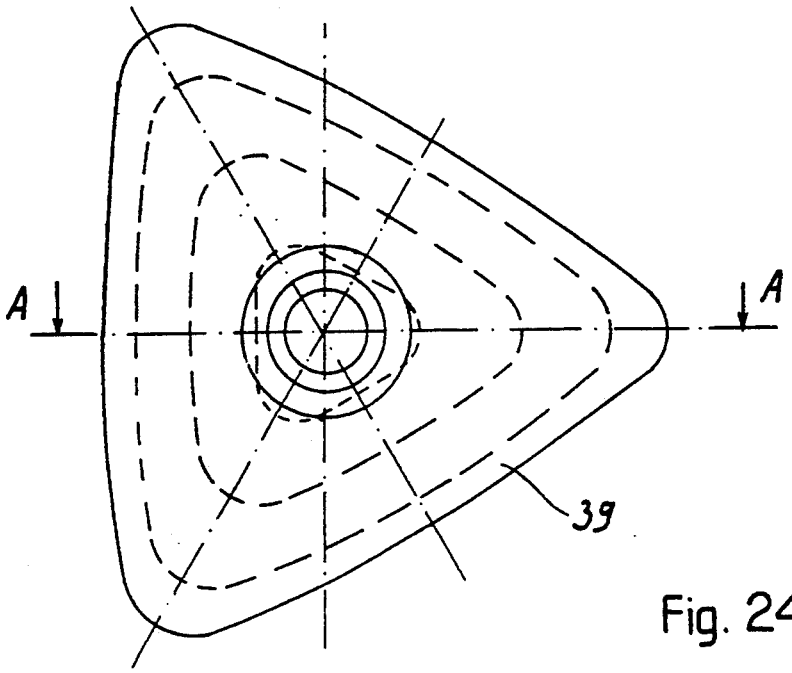
FIG. 24 is a top view of the fixed body connected to the central member in a further preferred embodiment of the present invention.

FIG. 24 illustrates a top view of the shaped-figure 39 connected to the central member 2 of a further embodiment of the logical toy according to the present invention.

Figure 25:
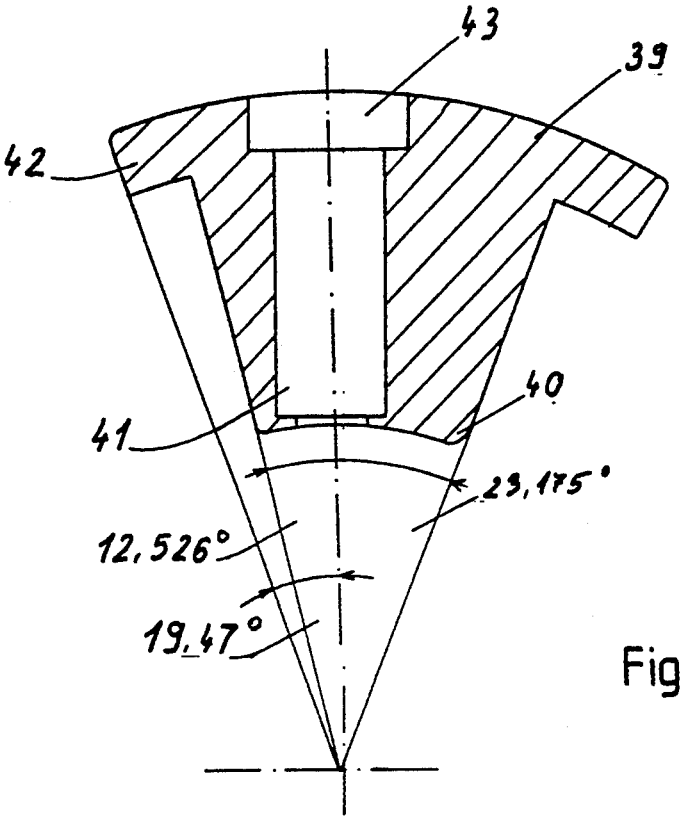
FIG. 25 is a sectional view along line A—A in FIG. 24.

The form of the shaped-figure 39 can be seen in FIG. 25 which is a sectional view taken along line A—A in FIG. 24.

The shaped-figure 39 as shown in FIG. 25 consists practically of a footing 40 of cone-frustum shape with an asymmetrical, curved component provided with a hole 41 receiving the shank 3 of the central member 2 and of an arched-triangle collared head-piece 42 connected to the footing 40, forming together therewith a common piece. FIG. 25 shows that the hole 41 receiving the shank 3 of the central member 2 ends in a groove 43 formed in the shaped-figure 39 adjacent to the collar 42. The function of the groove 43 is very important, as the head 54 of the shank 3 of the central member 2 introduced into the hole 41 snaps into the groove 38 thus fixing the shaped-figure 39 to the central member 2.

Figure 28:
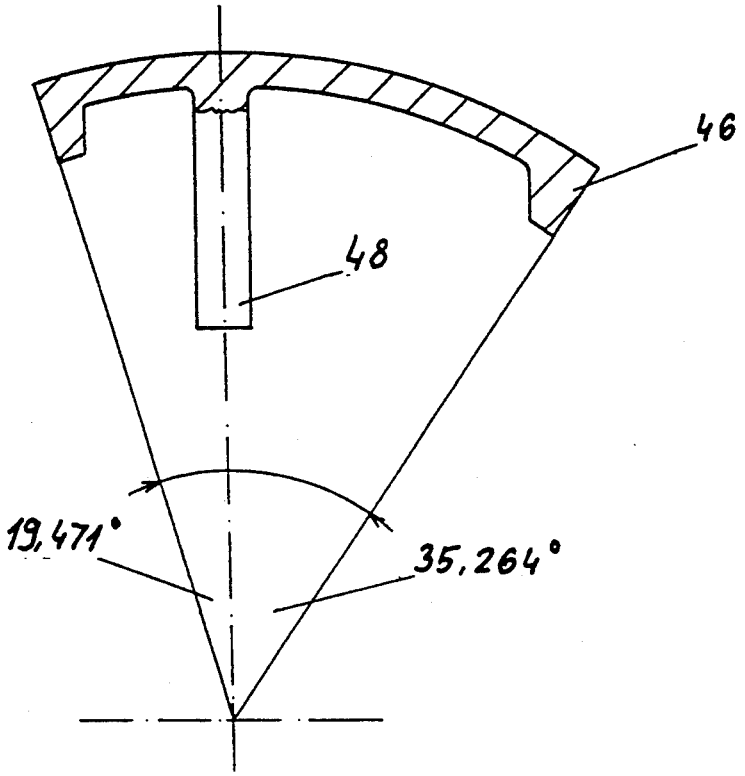
FIG. 28 is a sectional view of the outside covering closing the internal figure in FIG. 26.

FIG. 26 illustrates a top view of the shaped-figure 44 formed to be movable, attached to the shaped-figure 39, while FIG. 27 shows a sectional view taken along line B—B in FIG. 26. The shaped-figure 44 is formed practically of two parts: of an internal figure-part shown in FIG. 27 and of a covering 46 shown in FIG. 28 closing that internal figure-part from the top—from the surface of the main body 1.

The internal figure-part of shaped-figure 44 consists of a footing 45 of cone-frustum shape with an asymmetrical, curved component, provided with a hole 47 in axial direction, the pin 48 of the covering 46 having a surface of arched-triangle form can be introduced into the hole 47 of the footing. The solid connection among the parts of shaped-figure 44 is realized by tight fitting and adhesives, respectively.

Figure 29:
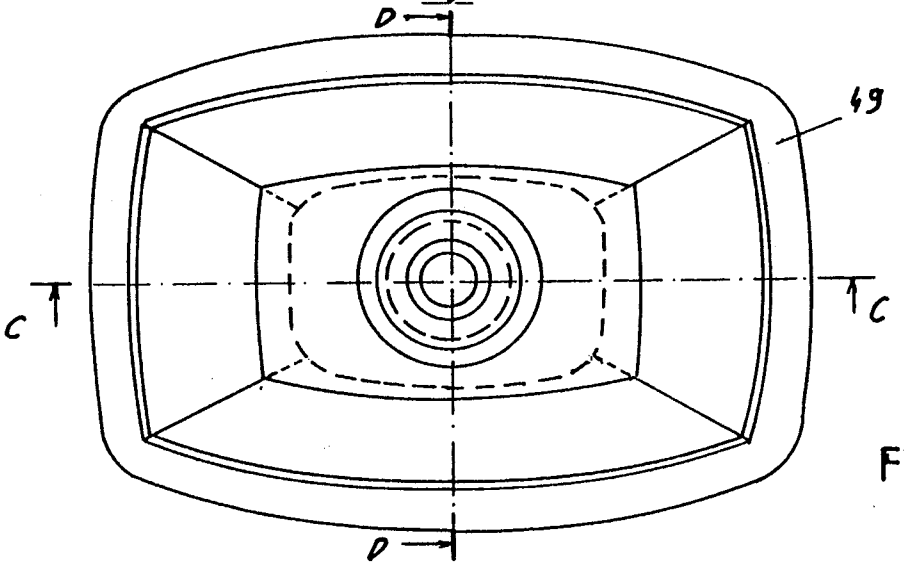
FIG. 29 is a top view of the inside part of the movable figure forming the main body attached to the figure in FIG. 24.

FIG. 29 illustrates a top view of the internal part of shaped-figure 49 connected to shaped-figure 39 and shaped-figure 44 respectively.

Figure 31:
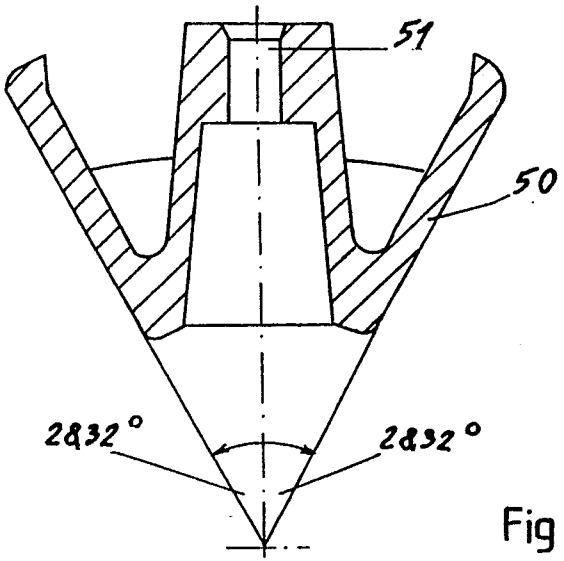
FIG. 31 is a sectional view taken along line D—D in FIG. 29.
Figure 30:
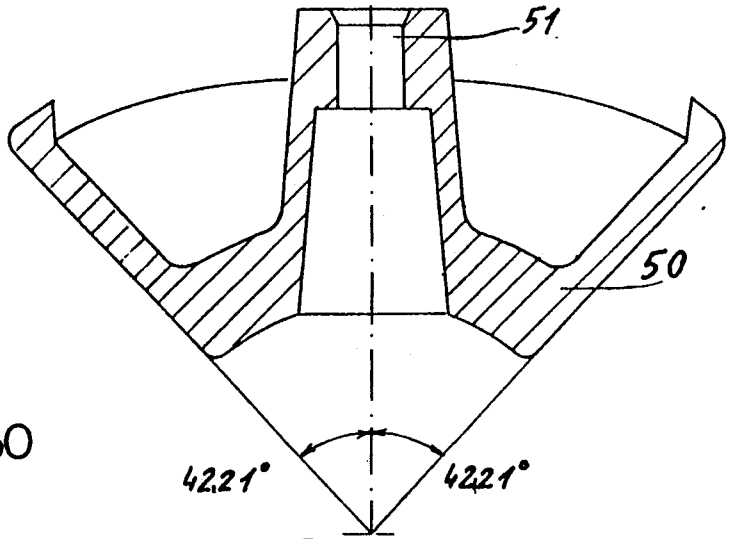
FIG. 30 is a sectional view taken along line C—C in FIG. 29.

FIG. 30 illustrates a sectional view taken along line C—C, while FIG. 31 illustrates the same taken along line D—D in FIG. 29.

Like the shaped-figure 44, the shaped-figure 49 is also formed of two parts: of an internal part with a footing 50 of cone-frustum type, with a curved component and of a covering 53 closing the internal figure-part from the surface of the main body 1. The form of the internal part of the shaped-figure 49 can be seen in FIGS. 30 and 31. The footing 50 of the shaped-figure 49 is provided with a bore 51 receiving the pin 52 of the covering 53.

Figure 34:
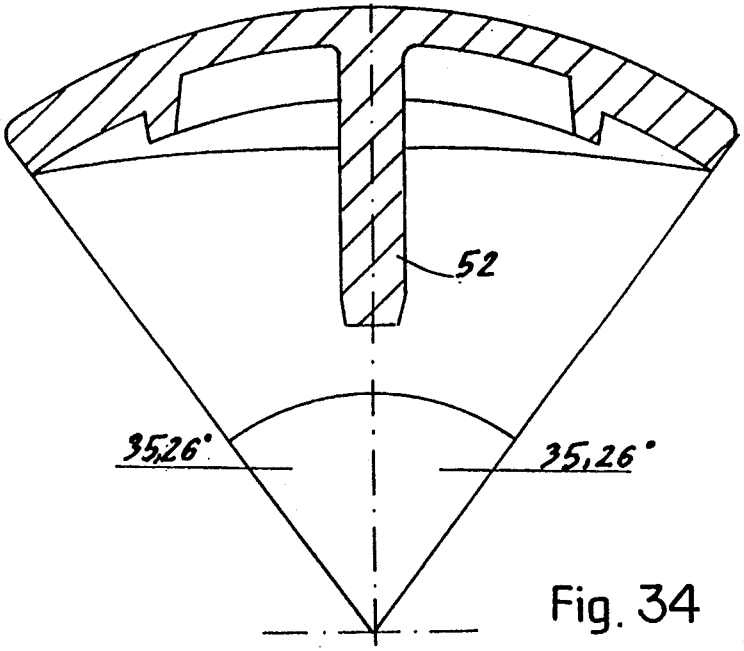
FIG. 34 is a sectional view taken along line F—F in FIG. 32.
Figure 32:
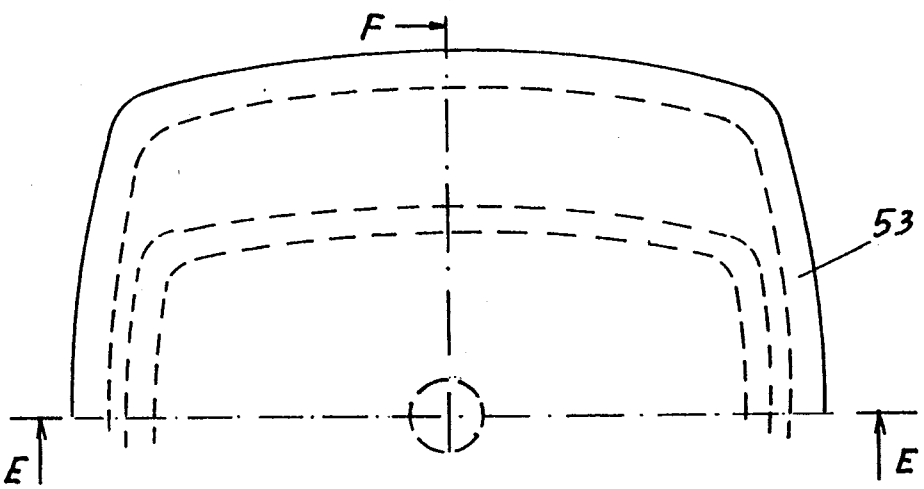
FIG. 32 is a top view of the covering closing the internal part in FIG. 29.

The form of the covering 53 closing the internal part of the shaped-figure 49 can be seen in FIGS. 32 to 34. FIG. 32 illustrates a top view of the covering 53, while FIG. 33 shows a sectional view taken along line E—E in FIG. 32 and FIG. 34 illustrates the same taken along line F—F. The solid connection between the internal part and the covering 53 of shaped-figure 49 is assured by tight fitting adhesives in the bore 51 respectively, formed in the internal part and the pin 52 of the covering 53.

The operation of the solid puzzle device built up from the shaped-figures shown in FIG. 32 to 34 will be explained herebelow.

By way of introduction it should be noted that in the present embodiment the pathway-system formed on the surface of the main body and the further elements moved on this pathway-system are superfluous, thus the toy can be realized solely by rotating the elements building up the main body along the main directions of rotation with the aid of the points of intersection.

On the surface-parts of the figures forming the main body, in the corners of the head-piece of the figures, there are different distinguishing surface features preferably different colors in an arranged form, and these color features are situated around a circle on the surface of the main body. The aim of the toy is to rearrange these distinguishing colors from a disordered arrangement into another, perfectly ordered one, by rotating them along the main directions of rotation.

The advantage of the solid puzzle device according to the present invention is that is develops the logical ability of its user and assures an enjoyable leisure time for everybody.

Another advantage of the solid puzzle device in accordance with the present invention lies in that it is suitable for playing various games with different complexity.

What is claimed is:

1. A spherical puzzle toy comprising:

a central member, including four radial shanks defining respective axes intersecting at a common point representing a center of a spherical surface of the puzzle toy;

a first group of four identical bodies respectively secured on said shanks in radial extension thereof, each of said four bodies including an inner portion secured on its respective shank and an outer portion forming a first part of the spherical surface of said puzzle toy, said inner portion having a tapered form with radial surfaces, said outer portion having a spherical, triangular shape;

a second group of bodies slidably supported by said first group of bodies and including inner portions of tapered form with radial surfaces which are slidable on one another and on the radial surfaces of said first group of bodies, said second group of bodies being of two types, one including outer portions of spherical, triangular shape, the other outer portions of spherical square shape, the outer portions of said first and second groups collectively forming said spherical surface of the puzzle toy, said outer portions undergoing relative change of positions on said spherical surface when bodies of said second group are slidably moved relative to the bodies of said first group.

2. A puzzle toy as claimed in claim 1, wherein said second group of bodies are relatively slidable with respect to said first group of bodies along four planes defined by the axes of said shanks.

3. A puzzle toy as claimed in claim 2, wherein said outer portions of said bodies of said first and second groups are provided with slots intersecting one another when said bodies occupy determined relative positions, said puzzle toy further comprising indicia means slidably movable in said slots for providing a distinct pattern on said spherical surface.

4. A puzzle toy as claimed in claim 3, wherein said slots have center lines which when developed in a flat plane form angles of intersection of about 60°.

5. A puzzle toy as claimed in claim 3, wherein said slots define twelve points of intersection.

6. A puzzle toy as claimed in claim 5, wherein along an equatorial circle formed on said spherical surface by each equatorial plane, there are six points of intersection of said slots extending alternately in opposite directions from said equatorial circle, said puzzle toy further comprising fixed indicia means including fixed indicia members of disc shape at said points of intersection.

7. A puzzle toy as claimed in claim 6, wherein said indicia means which is slidably movable in said slots includes slidable indicia members of disc shape.

8. A puzzle toy as claimed in claim 7, wherein said fixed and slidable indicia members include T-shaped extensions in said slots.

9. A puzzle toy as claimed in claim 8, wherein said fixed and slidable indicia members have outer surfaces with distinguishing surface features.

10. A puzzle toy as claimed in claim 9, wherein the surface features on said indicia members form flowers, each having a central petal formed by a fixed indicia member.

11. A puzzle toy as claimed in claim 1, wherein said outer portions of said first and second groups of bodies have shoulders which are slidable on one another.

12. A puzzle toy as claimed in claim 1, comprising indicia means on said first and second bodies forming said spherical surface to form a pattern on said spherical surface.

13. A puzzle toy as claimed in claim 1, wherein said central member comprises two congruent bodies secured together, each congruent body including two of said shanks.

14. A puzzle toy as claimed in claim 13, wherein said shanks of said congruent bodies form angles of about 109.5° with one another.

15. A puzzle toy as claimed in claim 13, wherein each said shank includes a head of conical shape with a longitudinal slot therein, said first group of bodies each having a longitudinal bore therein into which the head of a respective shank is snap-engaged.

16. A puzzle toy as claimed in claim 1, wherein said inner portions of said first group of bodies are asymmetrical.

17. A puzzle toy as claimed in claim 16, wherein each said inner portions have a curved radial face.

18. A puzzle toy as claimed in claim 1, wherein said bodies of said second group of said one type include an inner part forming said inner portion of tapered form and an outer part forming said outer portion of spherical, triangular shape, one of said parts including a pin, the other of said parts having a hole receiving said pin.

19. A puzzle toy as claimed in claim 1, wherein said bodies of said second group of said other type include an inner part forming said inner portion of tapered form an outer part forming said outer portion of spherical square shape, one of said parts including a pin, the other of said parts having a hole receiving said pin.

20. A puzzle toy as claimed in claim 1, wherein said outer portions of said first and second group of bodies have outer surfaces with distinguishing surface features to provide a determined, reproducible pattern on said spherical surface in a particular arrangement of said bodies of said first and second groups.

* * * * *